US005459283A

United States Patent [19]

Birdwell, Jr.

[11] Patent Number: 5,459,283

[45] Date of Patent: Oct. 17, 1995

[54] POWER SYSTEM FOR ELECTRONIC MUSICAL INSTRUMENTS

[76] Inventor: Stanley J. Birdwell, Jr., Four Oakview Dr., Millbury, Mass. 01527

[21] Appl. No.: 178,044

[22] Filed: Jan. 6, 1994

[51] Int. Cl.[6] ..... G10H 1/053; G10H 1/32

[52] U.S. Cl. ..... 84/737; 84/746

[58] Field of Search ..... 84/600, 626–633, 84/644, 662–665, 670, 701–711, 718, 721, 737–741, 743, 746, 3

[56] References Cited

U.S. PATENT DOCUMENTS

| | | |
|---|---|---|
| 4,338,846 | 7/1982 | Pogoda . |
| 4,788,448 | 10/1988 | Crowe . |
| 4,916,409 | 4/1990 | Tracy . |

OTHER PUBLICATIONS

Clifford, Martin, *Microphones*, 1986, pp. 92–95, 170–171.

Ballou, Glen, *Handbook for Sound Engineers*, 1987, pp. 336–340.

Owen, Frank, F. E., *PCM and Digital Transmission Systems*, 1982, pp. 204–205.

EFEK Elektronik product sheet "EBS–1 The Bassplayers Preamp" and EFEK Electronik EFS–1 users manual, pp. 2–26.

*Primary Examiner*—Stanley J. Witkowski

*Attorney, Agent, or Firm*—Fish & Richardson

[57] ABSTRACT

A power module transmits power to and simultaneously receives a signal from a remote signal processing device, such as an effects pedal, which in turn transmits power to and simultaneously receives a signal from a musical instrument, such as a guitar. The signal that is transmitted from the musical instrument is received at the effects pedal or remote signal processing device and is subsequently transmitted from the device to the power module. The signal is received at the power module and is transmitted from the power module to an amplifier or other signal processing device.

14 Claims, 4 Drawing Sheets

POWER SYSTEM FOR ELECTRONIC MUSICAL INSTRUMENTS

BACKGROUND OF THE INVENTION

The present invention relates to electric powering of musical instruments, e.g., electric guitars, and related equipment.

Electric guitars often have battery-powered preamplifiers carried by the guitars to amplify the electric signal, which is then transmitted over wires to an amplifier. A so-called effects pedal can be placed in the signal path between a guitar and amplifier to alter the sound of the guitar via some means of signal processing (analog or digital) and as such can be considered a remote signal processor. Some effects pedals have a potentiometer mechanically or optically connected to a "pedal" such that the signal processing "effects" may be controlled by the action of the player's foot. Effects pedals are typically powered by internal batteries or a direct connection via a second power cable to an external AC adapter.

SUMMARY OF THE INVENTION

In one aspect, the invention features, in general, providing electrical power from a base device to multiple remote devices while simultaneously transmitting electrical signals from the remote devices to the base device. The base device includes a signal receiver and a power supply. A first remote device (e.g., an effects pedal) includes first signal processing circuitry. A second remote device (e.g., an electronic musical instrument) includes active circuitry and a sound transducer. A first three-conductor wire connects the first remote device to the base device, a first conductor carrying a signal from the first signal processing circuitry to the signal receiver, a second conductor carrying power for the first signal processing circuitry from the power supply, a third conductor carrying ground. A second three-conductor wire connects the second remote device to the first remote device, a first conductor carrying a signal from the active circuitry to the first signal processing circuitry, a second conductor carrying power for the active circuitry from the first remote device, a third conductor carrying ground. The invention provides continuous and reliable power, unlike the prior use of batteries. Also, because power is provided on the same cable as the signal, there is no need for an AC outlet to be located near a remote device, and no need to use an AC adapter for power.

In preferred embodiments the power supply outputs DC power. The base device is a phantom power module that has a two-conductor output from the signal receiver for connection to a separate signal processor. The power supply includes a filter to remove AC components before transmitting electrical power to the remote devices. The first three-conductor wire and the base device are connected via a connector that causes the first wire to be electrically isolated from the second wire during connection. When employing the invention with existing, battery-powered remote circuitry, the battery is replaced by a shorting plug that snaps onto the battery connector terminals.

The three-conductor cables can be implemented by a standard stereo plug on the end connected to the instrument and an XLR type connector on the end connected to the effects pedal. On the stereo plug, the tip carries the signal source from musical instrument; the ring carries the power signal from power unit; and the sleeve carries the ground potential. On the XLR connector, pin 1 carries ground potential; pin 2 carries the signal source from the musical instrument; and pin 3 carries the power signal from the power unit.

In another aspect, the invention features an effects pedal that can be operated in a phantom-powered or a battery-powered mode and can be used with a passive musical instrument or a musical instrument with active circuitry.

Other advantages of the invention will be apparent from the following description of the preferred embodiment and from the claims.

DESCRIPTION OF THE PREFERRED EMBODIMENTS

I refer now to the drawings wherein the showings are for purposes of illustrating preferred embodiments of the invention only and not for purposes of limiting the same.

Structure

Figure 1:
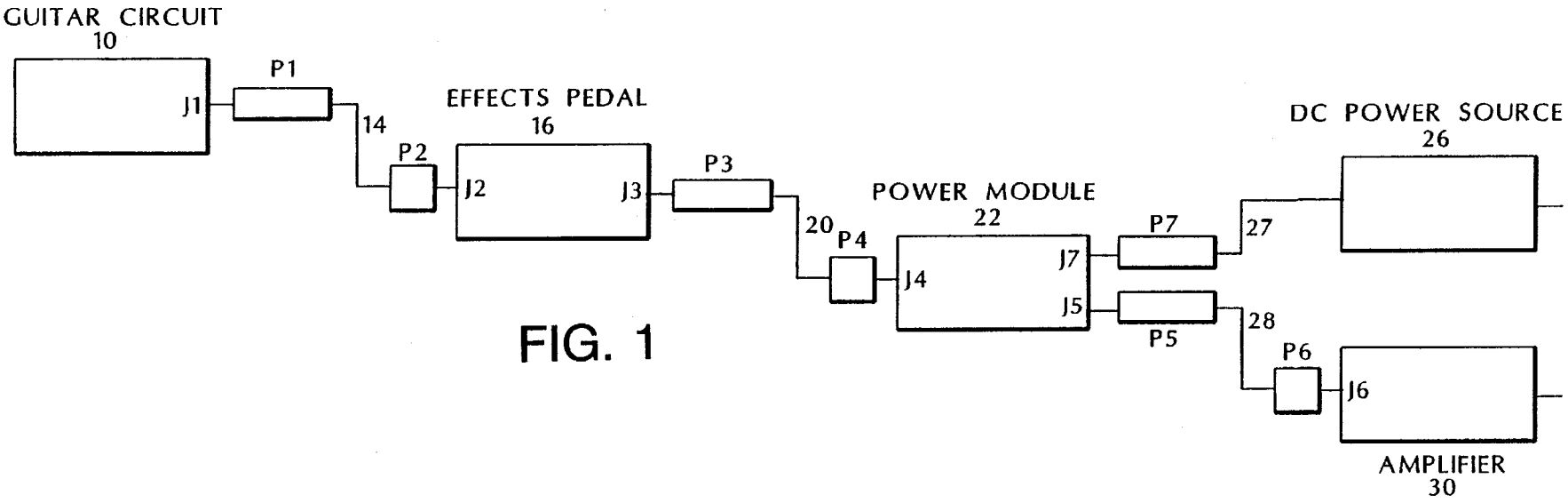
FIG. 1 is a block diagram of a system for providing distributed DC phantom power to a musical instrument, such as a guitar, and an effects pedal in accordance with the present invention.
Figure 2:
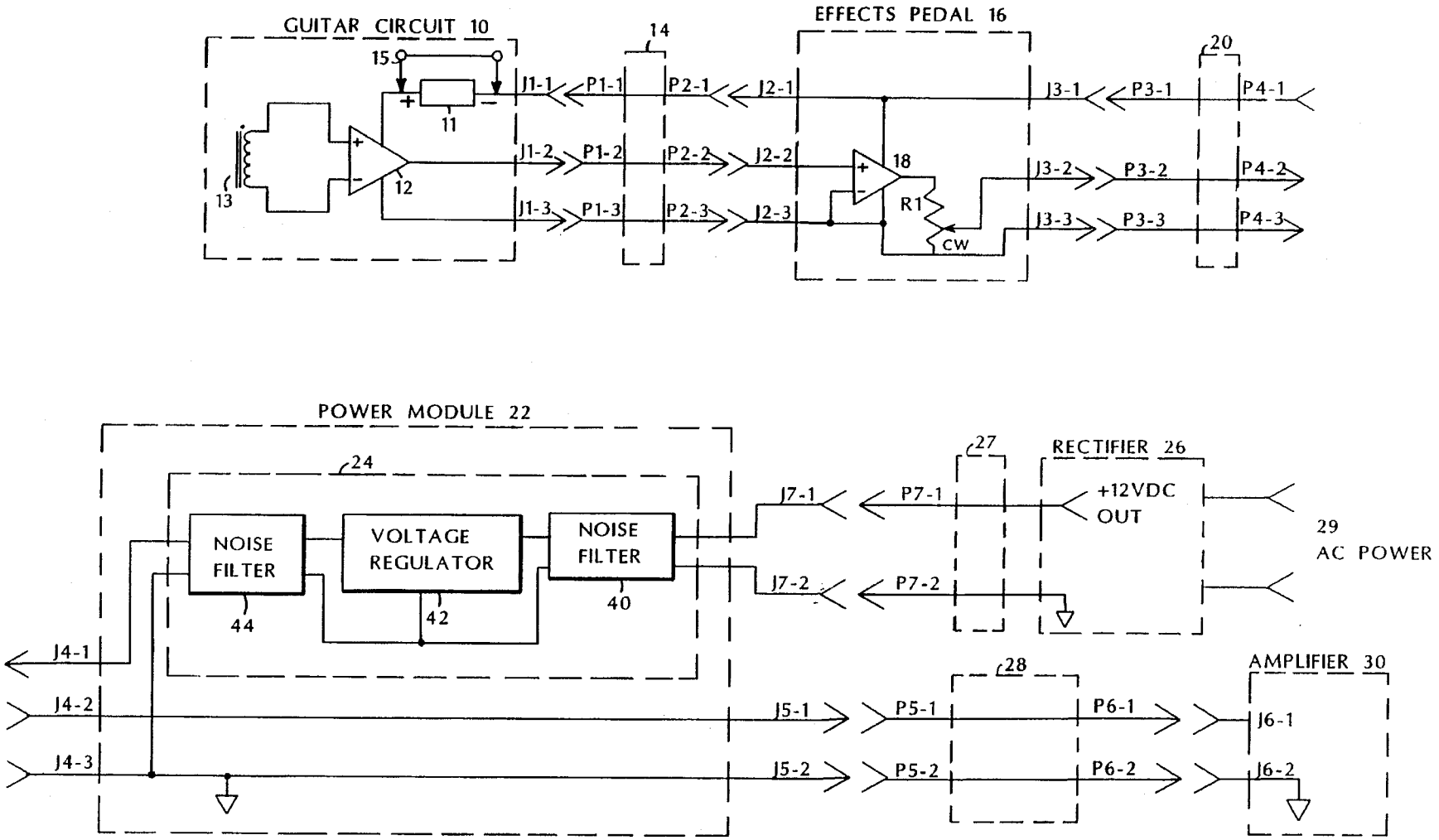
FIG. 2 is a schematic representation of the FIG. 1 system.

FIGS. 1 and 2 show guitar circuit 10 connected to effects pedal 16 via stereo (three-wire) cable 14. Effects pedal 16 (which could be a so-called "wah-wah" pedal or tone control pedal) is connected to phantom power module 22 via stereo (three-wire) cable 20. Phantom power module 22 is connected to amplifier 30 via mono (two-wire) cable 28. Phantom power module 22 receives DC power via cable 27 from external DC supply 26 (12V, 200mA wall transformer), having AC plug 29.

Referring to FIG. 2, guitar circuit 10 includes sound transducer 13 (a magnetic pickup or piezo transducer), active circuit 12 (a preamplifier) and shorting plug 15 connected to the connections for 9 volt battery 11, which is usually used to power active circuit 12 but is not needed owing to the phantom power provided by the invention. Phantom power module 22 includes power supply 24, in turn including input filter 40, voltage regulator 42, and output filter 44.

The definitions for the schematic symbols used in FIG. 2 are as follows:

J1 and J3 are stereo jacks.
P1 and P3 are stereo plugs.
J2 and J4 are XLR female connectors.
P2 and P4 are XLR male connectors.
J5 and J6 are mono jacks.
P5 and P6 are mono plugs.
P7 is a 3.5 mm plug.
J7 is a 3.5 mm jack.
R1 is a potentiometer.

Figure 3:
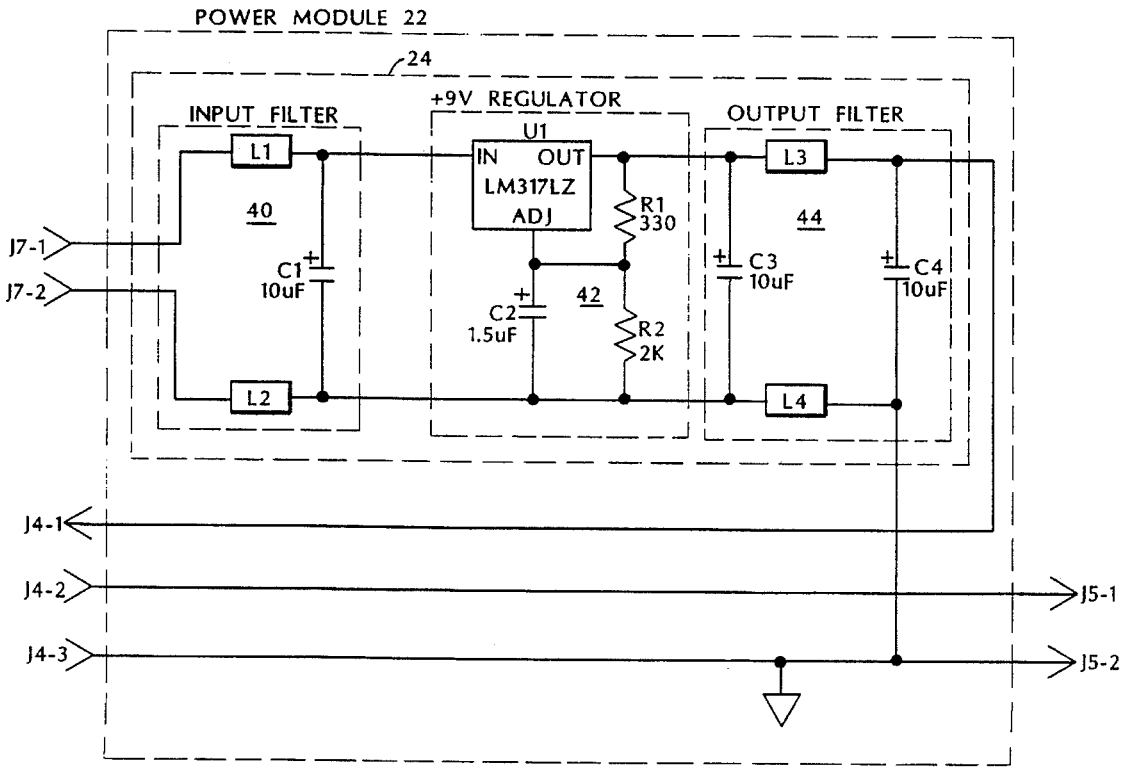
FIG. 3 is a schematic representation of a power module of the FIG. 1 system.

FIG. 3 shows phantom power module 22 and the components of its input filter 40, voltage regulator 42, and output filter 44 in more detail. They include:

| | |
|---|---|
| L1–L4 | ferrite beads |
| C1, 3, 4 | 10 uF capacitors |
| C2 | 1.5 uF capacitor |
| R1 | 330 ohm resistor |
| R2 | 2K ohm resistor |
| U1 | LM317 |

Operation

When phantom powering is employed to power guitar circuit 10, battery 11 is replaced by shorting plug 15, creating a short circuit between the plus and minus terminals of the battery connector. Power is applied directly to guitar circuit 10 via the P1-1/J1-1 connection to power active circuitry 12 using stereo cable 14.

A signal connection from guitar circuit 10 to effects pedal 16 is made via stereo cable 14 when P1 is inserted into J1, and P2 is inserted into J2. A power connection from effects pedal 16 to guitar circuit 10 is also made via stereo cable 14 when P1 is inserted into J1, and P2 is inserted into J2.

A signal connection from effects pedal 16 to phantom power module 22 is made via stereo cable 20 when P3 is inserted into J3, and P4 is inserted into J4. A power connection from phantom power module 22 to effects pedal 16 is also made via stereo cable 20 when P3 is inserted into J3, and P4 is inserted into J4.

A signal connection from phantom power module 22 to amplifier 30 is made via mono cable 28 when P5 is inserted into J5, and P6 is inserted into J6.

An AC voltage is supplied to the circuits via AC input plug 29. This voltage is rectified by DC supply 26 but is unregulated. The DC voltage is then transmitted to phantom power module 22 via cable 27. Power supply 24 within phantom power module 22 filters and regulates the DC voltage, which is then transmitted to the remote effects pedal 16 via conductor 1 of stereo cable 20, thus providing power to the active circuitry 18 of the remote effects pedal 16. The DC voltage is also transmitted from effects pedal 16 to remote guitar circuit 10 via conductor 1 of stereo cable 14.

Because battery 11 has been replaced with a short circuit, the DC voltage at conductor 1 of stereo cable 14 appears at active circuitry 12, thus providing power to active circuitry 12 of remote guitar circuit 10.

An electrical signal, originating from the transducer 13 in guitar circuit 10, is supplied to the input of active circuitry 12. Active circuitry 12 may be a simple buffer amplifier, active transducer, impedance matching device, or any such active circuitry as may be used in a musical instrument or guitar. The signal from active circuitry 12 is transmitted to signal processing circuitry 18 of effects pedal 16 via conductor 2 of stereo cable 14. Signal processing circuitry 18 may be any analog or digital signal processing device or any such active circuitry as may be found in an effects pedal.

The signal from signal processing circuitry 18 is transmitted through potentiometer R1 to the circuitry of the phantom power module 22 via conductor 2 of stereo cable 20. From phantom power module 22, the signal is transmitted to amplifier 30 via conductor 1 of cable 28. The signal transmitting circuitry of phantom power module 22 may be active or passive, and is shown here as a simple passive connection for clarity. An active circuit may be used between J4-2 and J5-1 of phantom power module 22 to buffer or process the electrical signal before transmitting the signal to an amplifier.

An XLR connector is used at the power module to protect the active circuitry in the guitar or remote signal processor from shorts that might otherwise occur when inserting plugs. There is no means for the signals to short to one another when the male XLR connector is plugged into the female XLR connector as would be the case when a stereo plug/jack combination is employed.

Note that in the above discussion all voltages (power and signal) are referenced to ground which is named as conductor 3 of stereo cables 14 and 20 and conductor 2 of monocable 28.

When it is desired to use battery 11 to power guitar circuit 10, this can be done by inserting a mono plug is into J1, and guitar circuit 10 will simply be powered as in the prior art. The sleeve of the mono plug effectively shorts J1-1 and J1-3, thus closing the circuit and causing current to flow from the battery to the active circuitry 12 and therefore providing power to the active circuitry 12.

The invention provides many advantages. The invention provides a user-friendly phantom powering interface between a guitar, an effects pedal and an amplifier by employing safety features not found in present phantom powering systems. The invention allows multiple effects pedals and a musical instrument to be phantom powered by a series power connection (daisy chaining) originating from a single power source via standard cables as may be used with a microphone or musical instrument. The invention provides a more efficient and reliable source of power than a battery is capable of supplying, thus enabling more active circuitry to be used remotely. The invention allows instruments with limited space (i.e., those that would not have space to contain a battery) to use active circuitry. The invention allows existing active circuitry contained in or near a musical instrument to be powered remotely and still be used with a conventional amplifier, preamplifier, or signal processing device which does not have the capability of providing "phantom" or external power.

Other Embodiments

Figure 4:
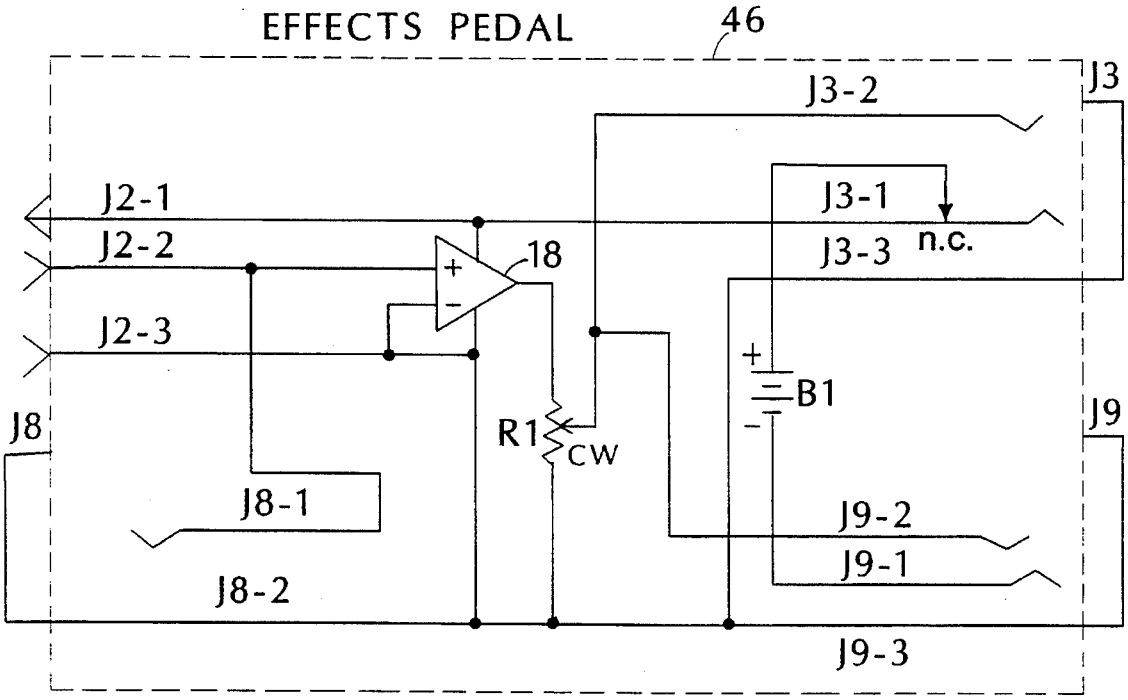
FIG. 4 is a schematic representation of an alternative embodiment of an effects pedal of the FIG. 1 system.

Other embodiments of the invention are within the scope of the appended claims. E.g., FIG. 4 shows alternative effects pedal 46 that permits use with a "passive" guitar (i.e., one not having active circuitry), a phantom powered guitar, or a battery powered guitar. Effects pedal 46 itself can be phantom powered or battery powered. In addition to the components of effects pedal 16 (FIG. 2), effects pedal 46 includes two additional connectors, J8 and J9, which are shown in FIG. 4. J8 accepts a mono plug that is attached to a pair of wires which carry the output signal from a passive guitar. J9 accepts a mono plug that is attached to a pair of wires which carry the output signal from effects pedal 46 to an amplifier.

For phantom power operation, XLR connector J2 and a stereo jack J3 are used as already described for effects pedal 16. J3 also incorporates a normally closed switch that opens when a plug is inserted into J3. This serves to disconnect the battery from the circuit when phantom powering is provided on J3-1. P3 (shown in FIG. 2), which plugs into J3, is attached to a stereo cable 20 as already described. The effects pedal is now phantom powered. Also note that, with this variation, a passive guitar may be used when effects pedal 46 itself is phantom powered. The possible configuration for effects pedal 46 shown in FIG. 4 are listed below:

| | Connector Used | | Power Source Used | |
|---|---|---|---|---|
| Config. | Input | Output | Guitar | Effect Pedal |
| 1 | J2 | J3 | phantom | phantom |
| 2 | J2 | J9 | battery | battery |
| 3 | J8 | J3 | none | phantom |
| 4 | J8 | J9 | none | battery |

It is noted that input J2 and input J8 cannot be used simultaneously; output J3 and output J9 cannot be used simultaneously. It is also noted that in Configuration 2 listed in the table, the guitar derives its power from the battery within the effects pedal via J3-1.

The present invention may be embodied in other specific forms without departing from the spirit or the essential attributes thereof and accordingly, reference should be made to the appended claims rather than to the foregoing specification as indicating the scope of the invention.

What is claimed is:

1. Apparatus for remote powering of an electronic audio device comprising a base device including a signal receiver and a power supply, a first remote device connected to said base device by a first three-conductor wire, said first remote device including first signal processing circuitry, a first conductor of said first three-conductor wire carrying a signal from said signal processing circuitry to said signal receiver, a second conductor of said first three-conductor wire carrying power for said first signal processing circuitry from said power supply, a third conductor of said first three-conductor wire carrying ground, a second remote device connected to said first remote device by a second three-conductor wire, said second remote device including a sound transducer and active circuitry, said active circuitry being connected to said transducer to modify an electric signal from said transducer, a first conductor of said second three-conductor wire carrying a signal from said active circuitry to said first signal processing circuitry, a second said conductor of said second three-conductor wire carrying power for said active circuitry from said first remote device, a third conductor of said first three-conductor wire carrying ground.

2. The apparatus of claim 1 where said second remote device is an electronic musical instrument.

3. The apparatus of claim 1 wherein said power supply outputs DC power.

4. The apparatus of claim 1 wherein said base device has a two-conductor output from said signal receiver for connection to a separate signal processor.

5. The apparatus of claim 1 further comprising a third remote device connected to said first remote device by said first three-conductor wire and to said base device by a third three-conductor wire, said third remote device including second signal processing circuitry, a first conductor of said third three-conductor wire carrying a signal from said second signal processing circuitry to said signal receiver, a second conductor of said third three-conductor wire carrying power for said second signal processing circuitry from said power supply, said first conductor of said first three-conductor wire being connected to said second signal processing circuitry, said signal from said first signal processing circuitry being processed by said second signal processing circuitry, said third remote device providing power over said second conductor of said first three-conductor wire to said first remote device.

6. The apparatus of claim 1 wherein said power supply includes a filter to remove AC components before transmitting electrical power to said remote devices.

7. The apparatus of claim 2 wherein said second remote device is an electric guitar including a conductor making a short-circuit across the terminals normally used to connect a battery to said active circuitry.

8. The apparatus of claim 1 wherein said first three-conductor wire and said base device are connected via a connector that causes said first wire to be electrically isolated from said second wire during connection.

9. The apparatus of claim 8 wherein said connector includes an XLR type plug and receptacle.

10. The apparatus of claim 1 wherein said first remote device also includes circuitry permitting connection of a passive remote device in place of said second remote device.

11. The apparatus of claim 10 wherein said first remote device also includes a battery connected to permit operation independent of said base device in a battery-powered mode.

12. A phantom powered effects pedal comprising a first three-conductor connector for connection to base device including a signal receiver and a power supply, first signal processing circuitry, a first conductor of said first three-conductor connector connected to carry a signal from said signal processing circuitry to said signal receiver, a second conductor of said first three-conductor connector connected to carry power for said first signal processing circuitry from said power supply, a third conductor of said first three-conductor wire carrying ground, a second three-conductor connector for connection to a musical instrument including a sound transducer and active circuitry connected to said transducer to modify an electric signal from said transducer, a first conductor of said second three-conductor connector connected to carry a signal from said active circuitry to said first signal processing circuitry, a second conductor of said second three-conductor connector connected to carry power for said active circuitry from said effects pedal, a third conductor of said first three-conductor connector carrying ground.

13. The effects pedal of claim 12 further comprising a first two-wire connector connected to circuitry permitting connection of a passive musical instrument in place of said musical instrument including active circuitry.

14. The effects pedal of claim 13 further comprising a battery connected to permit operation of said effects pedal independent of said base device in a battery-powered mode, and a second two-wire connector for connection to an amplifier.

* * * * *